United States Patent [19]

Callaway

[11] 4,435,864

[45] Mar. 13, 1984

[54] AIR BED ARRANGEMENT

[75] Inventor: Milton A. Callaway, Jackson, Oreg.

[73] Assignee: Simons U.S.A. Corporation, Atlanta, Ga.

[21] Appl. No.: 275,958

[22] Filed: Jun. 22, 1981

[51] Int. Cl.[3] ..... A47C 27/10

[52] U.S. Cl. ..... 5/453; 5/400; 5/455; 5/457; 5/470; 5/474

[58] Field of Search ..... 5/400, 449–457, 5/470, 474

[56] References Cited

U.S. PATENT DOCUMENTS

| | | | |
|---|---|---|---|
| 1,218,291 | 3/1917 | Meinecke . | |
| 1,356,148 | 10/1920 | Hobert . | |
| 1,371,362 | 3/1921 | Giese . | |
| 2,039,289 | 5/1936 | Bergeron . | |
| 2,415,150 | 2/1947 | Stein . | |
| 2,491,557 | 12/1949 | Goolsbee . | |
| 2,504,352 | 4/1950 | Robell . | |
| 2,542,781 | 2/1951 | Sawyer . | |
| 2,651,788 | 9/1953 | Forwood . | |
| 2,741,780 | 4/1956 | Kimbrig . | |
| 2,814,053 | 11/1957 | Sevcik . | |
| 2,823,394 | 2/1958 | Smith . | |
| 3,017,642 | 1/1962 | Rosenberg et al. . | |
| 3,110,520 | 11/1963 | Herding . | |
| 3,128,480 | 4/1964 | Lineback . | |
| 3,155,991 | 11/1964 | Dunham . | |
| 3,166,768 | 1/1965 | Cunningham . | |
| 3,287,749 | 11/1966 | Marsico . | |
| 3,421,163 | 1/1969 | Stoughton . | |
| 3,534,417 | 10/1970 | Boyles . | |
| 3,587,568 | 6/1971 | Thomas . | |
| 3,605,145 | 9/1971 | Graebe . | |
| 3,775,781 | 12/1973 | Bruno . | |
| 3,784,994 | 1/1974 | Kery | 5/456 |
| 3,789,442 | 2/1974 | Tobinick . | |
| 3,879,776 | 4/1975 | Solen . | |
| 3,950,798 | 4/1976 | Borsini . | |
| 4,109,333 | 8/1978 | Zmiarovich . | |
| 4,224,706 | 9/1980 | Young et al. | 5/455 |
| 4,234,983 | 11/1980 | Stumpf . | |
| 4,234,984 | 11/1980 | Stumpf . | |
| 4,245,363 | 1/1981 | Callaway . | |

*Primary Examiner*—Alexander Grosz

*Attorney, Agent, or Firm*—Scully, Scott, Murphy & Presser

[57] ABSTRACT

A bedding arrangement having a versatile mattress foundation which is designed to be utilized in combination with an accompanying inflatable mattress. The mattress foundation has a primary support structure for supporting a mattress and any loads imposed thereon, and a compartment is defined therein which houses an air compressor. The primary support structure includes a first area of support structure extending substantially the full height of the mattress foundation and a second area of support structure extending from the top surface of the foundation to only a portion of its full height, and the compressor compartment is positioned below the second area of support structure. The air compressor is pneumatically coupled to the inflatable mattress to provide a very convenient control over its internal pressure and resultant firmness. In one disclosed embodiment, a control panel is positioned on one side of the foundation to provide for convenient control over the compressor and mattress internal pressure.

15 Claims, 7 Drawing Figures

AIR BED ARRANGEMENT

BACKGROUND OF THE INVENTION

1. Field of the Invention

The present invention relates generally to an air bed arrangement having a unique mattress foundation, and more particularly pertains to a bedding arrangement having a mattress foundation which is designed to be utilized in combination with a pneumatically inflatable mattress.

2. Discussion of the Prior Art

In a normal bedding arrangement, a mattress foundation is generally placed under a mattress, and typically has a construction in which an array of vertically positioned nested or non-nested coil springs are stapled onto an underlying wooden frame in an arrangement commonly known in the art as a boxspring.

The prior art in the general mattress field has also developed to a substantial degree inflatable types of mattresses. For instance, Smith U.S. Pat. No. 2,823,394 is somewhat typical of known types of inflatable mattresses, and discloses a mattress having a pneumatic core divided into a plurality of independently inflatable cells positioned in an outer flexible envelope. An inflatable mattress of this type is normally connected to an external pump or compressor to increase its internal pneumatic pressure, thereby rendering adjustment of the pressure a relatively cumbersome task.

SUMMARY OF THE INVENTION

Accordingly, it is a primary object of the present invention to provide a bedding arrangement having a mattress foundation which is designed for use with a pneumatically inflatable mattress to provide a product which is relatively convenient to use and adjust.

A further object of the subject invention is the provision of a bedding arrangement of the aforementioned type which is extremely versatile in allowing a user thereof to conveniently adjust the firmness of the arrangement without resorting to an external pump or compressor.

In accordance with the teachings herein, the present invention provides a bedding arrangement having a versatile mattress foundation which is designed to be utilized in combination with an accompanying inflatable mattress. The mattress foundation has a primary support structure for supporting a mattress and any loads imposed thereon and a compartment is defined therein which houses an air compressor. The air compressor is pneumatically coupled to the inflatable mattress to provide a very convenient control over its internal pressure and resultant firmness. In one disclosed embodiment, a control panel is positioned on one side of the foundation to provide for convenient control over the compressor and mattress internal pressure.

In greater detail, the primary support structure includes a first area of support structure extending substantially the full height of the mattress foundation and a second area of support structure extending from the top surface of the foundation to only a portion of its full height, and the compressor compartment is positioned below the second area of support structure. In a particularly advantageous embodiment, the first support area of the foundation includes a first inflatable support structure extending substantially the full height of the mattress foundation, and a second inflatable support structure extending from the top surface of the foundation to only a portion of its full height.

In a second disclosed embodiment of the present invention the mattress foundation includes a first array of coil springs extending for substantially the full height of the mattress foundation and a second array of coil springs extending from the top surface of the foundation to only a portion of its full height.

In one particularly versatile disclosed embodiment the mattress is formed of two separable components, an outer peripheral or border section and a central core unit. A pillow top for the mattress is removably fastened to the border section to allow access to the central core unit. The central core unit is constructed of top, bottom and side surfaces which are joined together to form an inflatable outer shell. The outer shell is divided into a plurality of separate internal compartments by spacer surfaces extending between the top and bottom surfaces and designed to maintain a substantially rectangular shape for the outer shell. The separate compartments pneumatically communicate with each other through apertures in the spacer surfaces such that the resilient firmness of the outer shell is adjustable by one common internal pressure.

In the aforementioned versatile embodiment, the mattress peripheral section can be constructed of non-nested pocketed coil springs formed of a metallic or plastic material. The pocketed coil springs are interconnected during constructon of the mattress unit by ultrasonic welding of the material housing the coil springs.

An important consideration in mattress construction lies in the provision of a mattress which affords a maximum degree of comfort to the individual user, in effect, with respect to the firmness obtained through the internal construction thereof, particularly with regard to the center portion of the mattress which is subjected to extensive usage. Inasmuch as different users often prefer mattresses having a wide variety of consistencies and degrees of firmness, it is readily understandable that, in order to be able to satisfy a broad range of consumer demands, this would necessitate the manufacture of many types of mattresses affording the consumer a wide choice of selection. Obviously this presents problems in the economy of manufacturing and stocking of a large supply of mattresses having different characteristics and firmness in order to be able to meet most consumer needs.

In order to ameliorate these problems, there has been developed the aforementioned concept of a versatile mattress arrangement having a basic mattress border or perimeter construction which, in combination with a replaceable and interchangeable core portion forming the major supporting area of the mattress, facilitates a rather inexpensive manufacture of the mattress while imparting a versatility in construction and adaptability to consumer needs not heretofore encountered in the prior art. The mattress foundations disclosed herein have particular applicability as foundations for the aforesaid versatile mattress arrangement.

An important aspect of a particular embodiment of the present invention resides in the provision of a mattress of the aforementioned type which facilitates an adaptability for showroom demonstration and emphasizes the versatility thereof to potential customers. In effect, the insertable and interchangeable core imparts a customized property to the mattress without the need for expensive modifications to the basic mattress construction. Thus, a wide range of customer needs and individual tastes can be demonstrated in a simple and inexpensive manner through a simple interchange of the core portion of the mattress in a standardized outer perimeter frame structure.

Another feature of the aforementioned mattress arrangement consists of its ready adaptability to field servicing and replacement of worn or damaged mattress components without the need to return the mattress to a factory or the requirement for skilled servicing personnel.

In addition to the foregoing, the insertable core allows for the insertion therebeneath of an orthopedic bed board into the perimeter support structure by either the user or by personnel in the retail outlet selling or servicing the mattress arrangement. This, of course, again enlarges the scope of application of the mattress arrangement to a wider public and enhances the saleability of the product.

Yet another feature of a particular embodiment of the present invention comprises the provision of a mattress arrangement as described herein which is adapted for showroom demonstrations of numerous variations thereof so as to apprise potential customers of the versatility of the arrangement.

BRIEF DESCRIPTION OF THE DRAWINGS

The foregoing objects and advantages of the present invention for a versatile bedding arrangement may be more readily understood by one skilled in the art with reference being had to the following detailed description of several preferred embodiments thereof, taken in conjunction with the accompanying drawings wherein like elements are designated by identical reference numerals through out the several drawings, and in which.

DETAILED DESCRIPTION OF THE DRAWINGS

Figure 1:
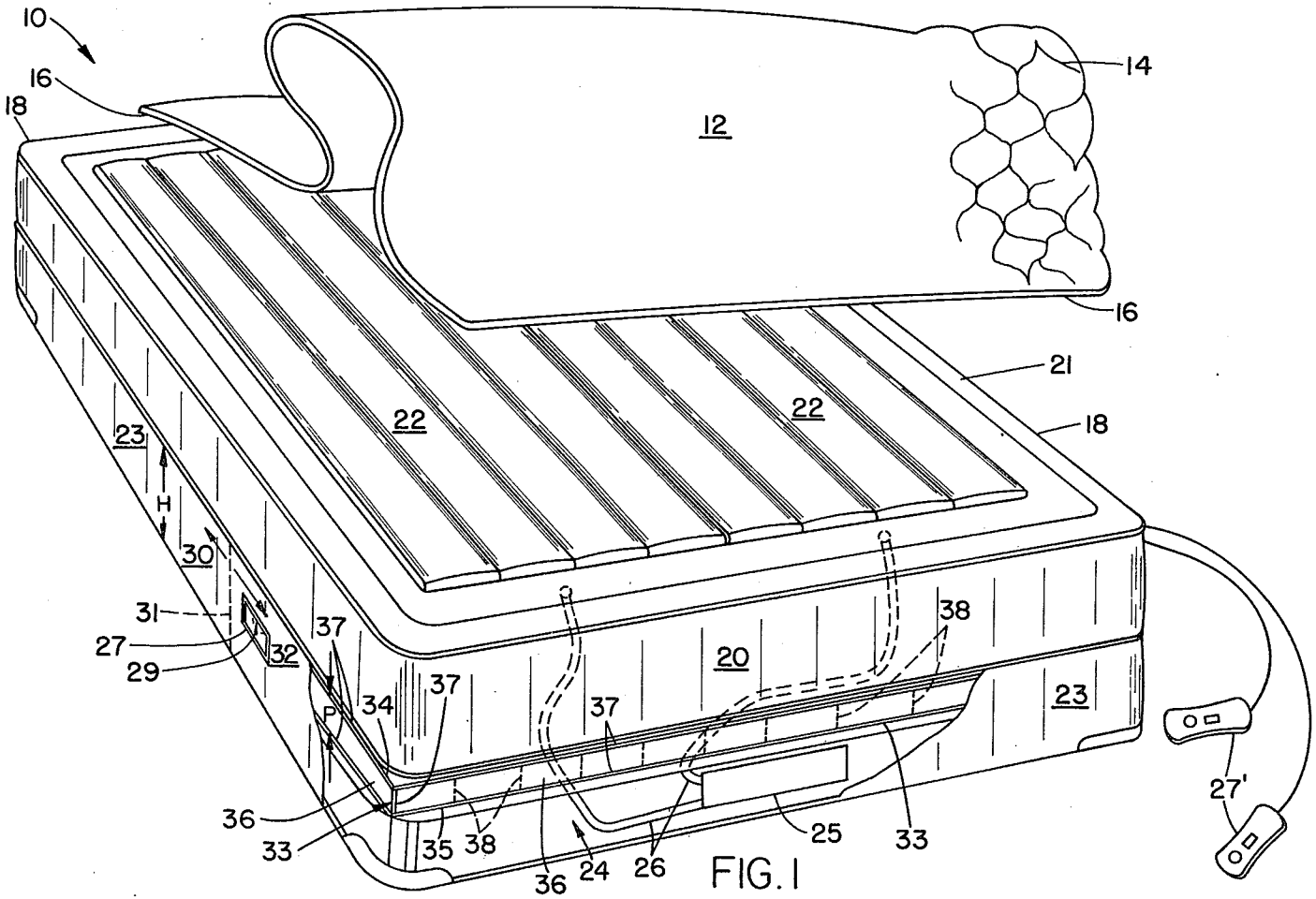
FIG. 1 is a perspective, partially sectional view of a first embodiment of a versatile bedding arrangement constructed pursuant to the teachings of the present invention.

Referring to the drawings in detail, FIG. 1 is a perspective view of an exemplary embodiment of a mattress 10 constructed with a removable pillow top cover 12. Pillow top 12 may have a suitably quilted cloth top 14 which has a fastener track 16 secured around its rectangular peripheral edge. A corresponding fastener track 18 is secured around the rectangular peripheral edge of a mattress body 20, such that the pillow top 12 and mattress body 20 may be fastened together or separated from each other.

Mattress body 20 includes an outer peripheral border or collar section 21 and at least one removable core unit 22, with two core units 22 being illustrated in FIG. 1 in a double bed arrangement. With this type of construction, the core unit 22 is replaceable, and may be selected at the time of purchase to be soft, firm, extra firm, etc. Alternatively, the core unit may take different types of construction, such as for instance a foam rubber construction or a traditional coil spring construction or a fluid filled construction pursuant to the disclosed embodiments of the present invention, or variations and combinations on these different types of construction. A second pillow top may also be removably zippered to the bottom of mattress body 20, such that a very flexible, interchangeable arrangement of components is presented thereby. The zippers are preferably of the type that they are concealed, as by a flap, after closure thereof, and in some embodiments can be hook and loop type fasteners such as are sold under the trademark of VELCRO.

FIG. 1 also illustrates features of the present invention which provide a bedding arrangement which is extremely versatile in allowing a user thereof to conveniently adjust the firmness of the arrangement without resorting to an external pump or compressor. In accordance with the teachings herein, a versatile mattress foundation 23 is designed to be utilized in combination with the accompanying inflatable mattress core units 22. The mattress foundation 23 has a primary support structure for supporting a mattress and any loads imposed thereon, and a compartment 24 is defined therein which houses an air compressor 25. The air compressor is pneumatically coupled by hoses 26 to the inflatable mattress core inserts 22 to provide a very convenient control over their internal pressure and resultant firmness. In the illustrated embodiment, a control panel 27 is positioned on one side of the foundation 23 to provide for convenient control over the compressor and mattress internal pressure. In various embodiments, the hoses 26 can be coupled to the core inserts 22 and/or the control panel 27 through any convenient concealed paths in the bedding arrangement.

In one embodiment, the control panel might include only an on-off switch for the compressor 25. A simple bleeder valve arrangement may be additionally provided such that the compressor is turned on to increase pressure and the bleeder valve is actuated to decrease pressure. In more complex embodiments, separated inflation controls, for example by a three way valve 29 located at the control panel, may be provided to allow selective individual inflation of each comfort core. The same valve would be employed to bleed the cores by, for example, coupling one of the cores to the compressor while not turning that unit on. Other types of control systems may be employed as well.

In greater detail, the primary support structure includes a first area of support structure 30, rearward of line 31 as indicated, extending substantially the full height H of the mattress foundation and a second area of support structure 32, forward of line 31 as indicated, extending from the top surface of the foundation to only a portion P of its full height H, and the compressor compartment 24 is positioned below the second area of support structure.

In a particularly advantageous embodiment illustrated in FIG. 1, the first support area of the foundation includes a first inflatable support structure in area 30 extending substantially the full height of the mattress foundation, and a second inflatable support structure 33 in area 32 extending from the top surface of the foundation to only a portion P of its full height. In this type of construction, an inflatable mattress foundation has a base frame for the foundation, generally constructed as a flat wooden frame. An air base is positioned on the base frame, and has top 34, bottom 35 and side surfaces 36 which are joined together to form an inflatable outer shell. The several surfaces are joined together, as by heat seaming, at their edes to form relatively square boxed edge seams 37, which contribute to a desired square or boxed shape for the mattress foundation.

The air base is divided into a plurality of separate compartments by spacer surfaces 38 extending between the top and bottom surfaces 34 and 35 which have a plurality of apertures therethrough to allow pneumatic communication between the several compartments. The spacer surfaces are preferably dual channel, closed loop surfaces which are joined to the top and bottom surfaces, as by heat seams, to maintain a substantially rectangular shape for the air base. The top, bottom and side surfaces of the air base and the spacer surfaces are preferably relatively heavy vinyl sheets which can be heat seamed together, one to the other, as by conventional heat seaming techniques. An exterior covering for the air base is also provided to present a unitary and conventional appearance for the mattress foundation. The exterior covering can include a top foundation surface and four side surfaces for the foundation, and a fastener which is provided for fastening the covering to the bottom of the foundation. The fastener preferably includes a Velcro® fastener extending longitudinally along at least one side of the foundation bottom, as disclosed in the aforementioned patent application.

One advantageous feature of this embodiment is that the compressor 25 can also be connected to the pneumatic mattress foundation for selective inflation thereof, and the control panel 27 can also include controls for inflation/deflation of the pneumatic foundation.

Figure 2:
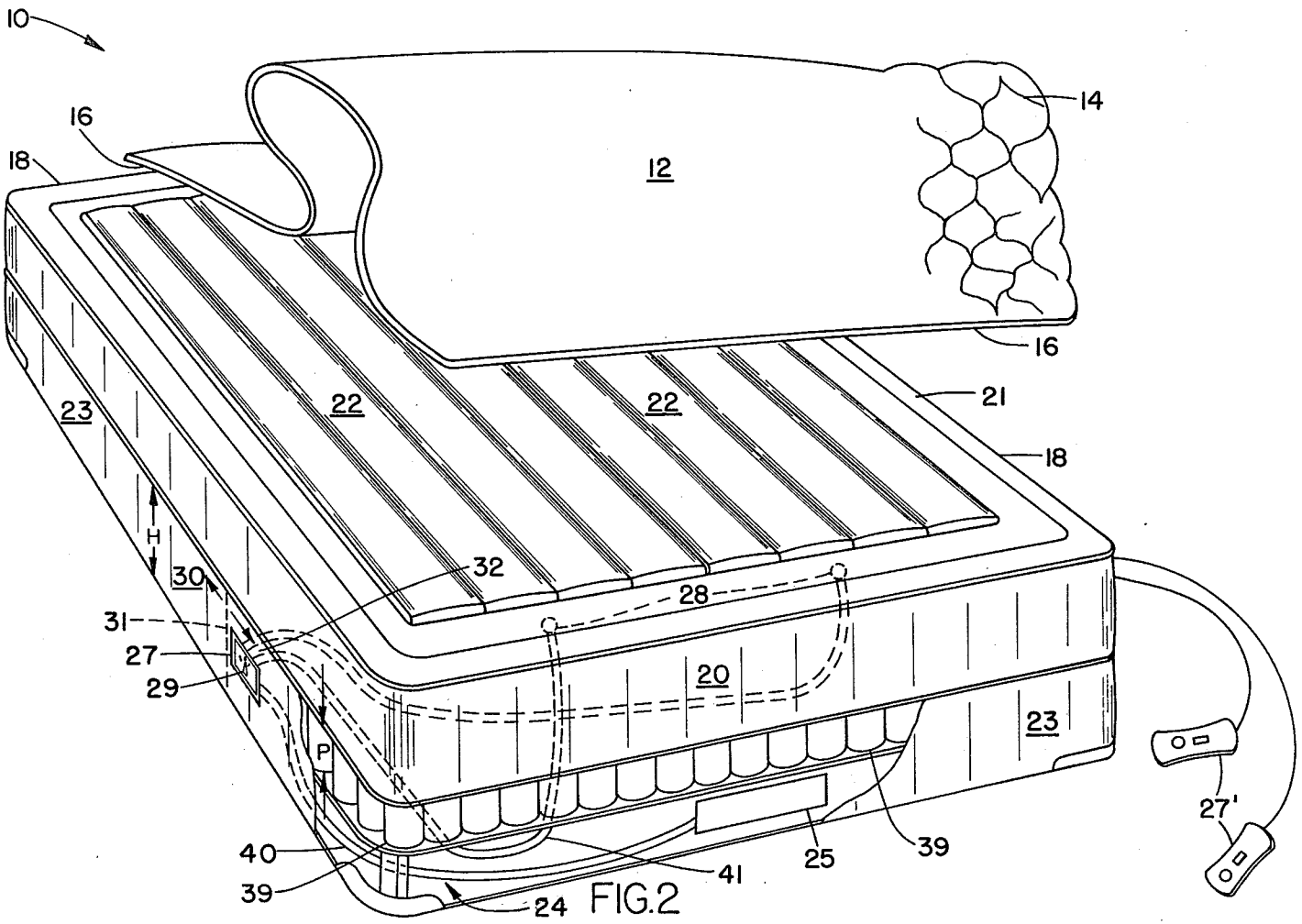
FIG. 2 is a perspective, partially sectional view of a second embodiment of the subject invention.

In a second embodiment of the present invention illustrated in FIG. 2, the mattress foundation 32 includes a first array of coil springs in support area 30 extending for substantially the full height H of the mattress foundation, and a second array of coil springs 39 extending from the top surface of the foundation to only a portion P of its full height. The pneumatic arrangement of this embodiment is also slightly different, with a single hose 40 leading from the compressor 25 to the control panel 27. Hoses 41 then connect the inflatable core units to appropriate valves on the control panel. In a third embodiment similar to that illustrated in FIG. 2, a pneumatically inflatable foundation could include a plurality of separate air springs, rather than the coil springs.

The outer border or collar section 21 may include encompassing upper and lower border wires consisting of inner and outer wires of round, rectangular or any suitable cross-section which are interconnected to a plurality of coil springs extending about the perimeter of the frame structure. The wires and the coils springs form a generally rigid but resiliently yieldable rectangular mattress frame adapted to confortably support the weight of a person sitting on the edge of the mattress. The wires and coil springs may be formed of metal or of a suitable plastic material such as vinyl. The outer frame structure 20 may be covered on all exposed sides thereof with a suitable covering material such as matress ticking, or a tufted or quilted mattress pillow material which imparts a soft and luxurient look and feel to the mattress. The mattress covering material may, if desired, consist of an either woven or non-woven breathable fabric, such as synthetic fiber material, cotton or combinations of materials which afford the necessary comfort to a user resting or sleeping on the mattress. Moreover, the mattress arrangement may incorporate a mattress pillow top filled with down or other soft foam-like material which will impart a particularly full and luxurient look and texture to the mattress.

Figure 3:
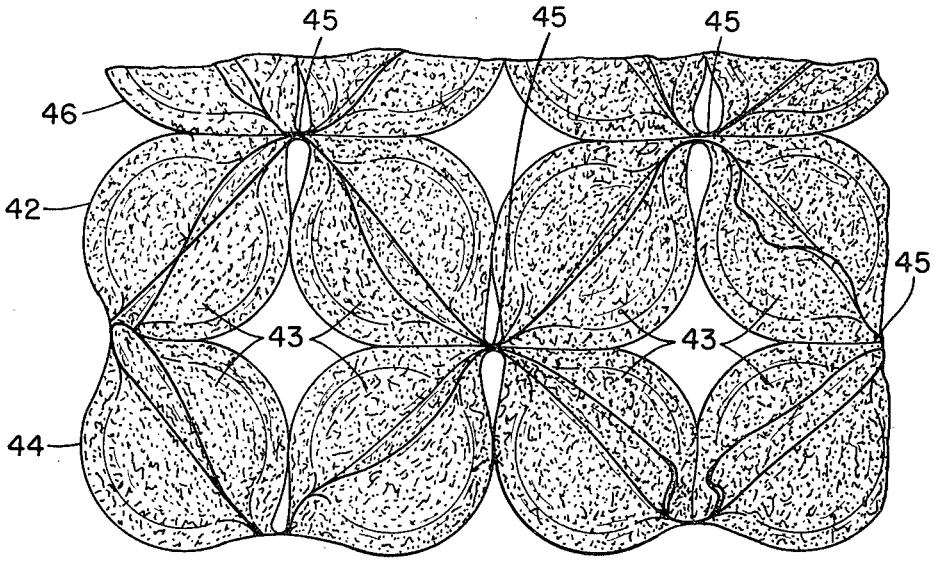
FIG. 3 is an enlarged plan view of a corner face of a rectangular pocketed spring assembly, with the spring dispersed in non-nested square array.
Figure 4:
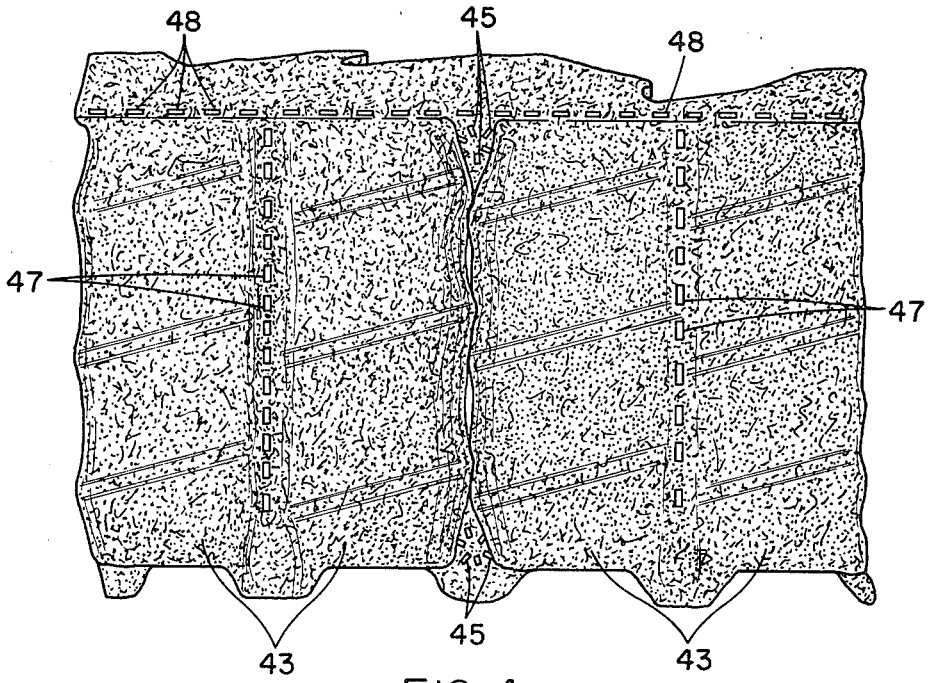
FIG. 4 is a fragmentary elevational view of the assembly of FIG. 3.

In a alternative embodiment, the peripheral border section 21 may be constructed of pocketed springs, or may be constituted of a plastic or foamed material. Thus, for instance, the peripheral border section 21 may consist of a rectangular or so-called square array or arrangement of non-nested coil springs of the type disclosed by Stumpf U.S. Pat. No. 4,234,984 assigned to the Simmons Company, the disclosure of which is incorporated herein by reference. In greater detail, in the Stumpf construction which is illustrated in FIGS. 3 and 4, a pocketed spring assembly has a given strip 42 of pocketed springs 43 connected to each adjacent strip 44 by connecting the two fabric strips together. Although the overall pattern of the assembly may tend to confuse the eye, reference should be made initially to the fragmentary enlargements of FIGS. 3 and 4, from which it is more readily apparent that the connection 45 of a given strip of springs to its neighboring strip are made between a pair of successive springs 43 of each strip, and are alternated along any given strip, e.g., strip 42, so that the given strip is connected first to the neighboring strip on one side, e.g., strip 44, then to the neighboring strip on the opposite side, e.g., strip 46, and so forth, along the entire given strip from one end or side of the assembly to the other.

The interstrip connections 45 are conveniently, although not necessarily, made near the opposite faces of the spring assembly, where, because of the preferred barrel shape of the coil, the slack of the fabric between successive pockets near the ends of the coils facilitates the insertion of a tool appropriate to make the connection.

As a result of the connection, the pair of coils of each strip immediately adjacent to the interstrip connection 45 are joined with an opposing pair in a configuration which, in plan, resembles a four-leaf clover, each spring pocket being rotated approximately one-eight turn away from the longitudinal axis of its own strip.

The strips of pocketed coils chosen to illustrate the invention are produced commercially, and comprises a folded two-ply strip of non-woven fabric of thermoplastic fibers in which the spring pockets are defined between the piles by transverse lines 47 of discrete thermal welds of the piles to one another, and in which the pockets formed in the two-ply strip are closed by a longitudinal seam 48 of similar welds to confine the springs in the pockets. When the springs are permitted to expand after being confined within the pockets, they impose their shapes upon the confining pocket walls in the mid-height of the pockets and produce a ruffle in the flaps of the closing seam, and at the opposite non-seamed end of the spring pocket as well, as the separation of the plies by the expanded spring foreshortens the cloth strip. This results in a slack reach of fabric along the interpocket seam 47 at each end thereof, an effect accentuated somewhat by the barrel shape of the coils 43 with which the structure is specifically illustrated.

The divergence of adjacent spring coils 43 at their ends resulting from the barrel shape provides convenient access to the strip material which, in the illustrated instance is welded to the material of the adjacent strip in the corresponding reaches of fabric between two successive coils of each strip, so that in the presently preferred and illustrated form, the adjacent strips are connected together, as at 45 near the tops and bottoms of the coils, but preferably interiorly of the end convolutions thereof.

The assembly of springs by connecting the strips together, rather than by connecting the springs, as such, to one another, permits each spring to maintain a considerable degree of individual action before requiring the depression of its neighbors in the clover leaf array, and yet, beyond the point, as in areas of concentrated load under the proportionally heavier parts of the body, or when the spring assembly is highly loaded as by bearing the weight of the occupant in sitting position, the clover leaf connection of four springs together in a closely knit group associates them cooperatively so that each can assist the other to regain the full unloaded height permitted by the confining pocket when the concentrated load is subsequently removed.

The pocket material of the preferred assembly is a thermoplastic sheeting, preferably of fibrous material whether or not of continuous filament or staple fiber length, and whether spun or woven, or laid as a nonwoven fabric. When the constituent material is thermoplastic, as indicated, the joining technique employed in making the assembly, as well as making the pocketed spring strip itself, may be thermal welding, a localized or spot atachment of adjacent strips being made at or near the end convolutions of the strips along the seam between adjacent pockets in that relatively slack reach of the pocket material provided by the diverging outlines of the barrel-shaped spring coils resulting from the smaller diameter of their respective end convolutions. These connections can readily be made with available welding equipment, and do not appear to interfere materially with compression of the springs individually throughout a substantial portion of their respective heights.

Based upon the considerable history of manufacture of pocketed spring coil assemblies wherein the pocket material were of spun and woven staple fibers of natural origin, the specific mode of attachment of adjacent strips to one another in accordance with the construction may be something specifically different from thermal welding, the ultimate objective being the secure, reliable, and non-destructive attachment of the adjacent strips to one another. This may, for example, take the form of stitching, or twine ties, or metal fasteners such as hogrings, staples, or the like, or an adhesive capable of adequately penetrating the four plies of a textile fabric with or without heat and pressure.

The peripheral frame structure may consist of nonnested pocketed upholstery springs assembled into the so-called Marshall construction as described in Stumpf U.S. Pat. No. 4,234,983, assigned to the Simmons Company, the disclosure of which is also incorporated herein by reference. In this instance the pockets with the individual coil springs are formed between overlaid plies of a two-ply strip of material by lines of separate individual welds which interconnect the plies. These welds between the material plies may be effected in an ultrasonic method and arrangement.

Figure 5:
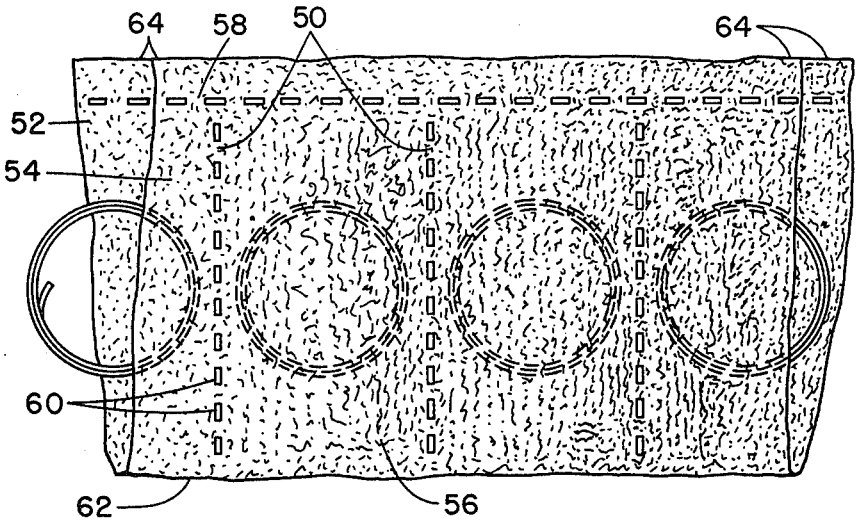
FIG. 5 is an enlarged plan view of a series of pocketed springs of the so-called Marshall construction.
Figure 6:
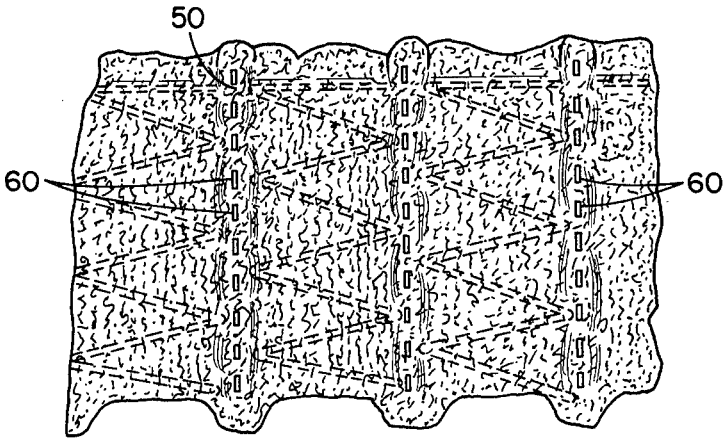
FIG. 6 is a fragmentary elevational view of the springs of FIG. 5.

In greater detail, and as illustrated in FIGS. 5 and 6, the transverse lines of attachment of the overlaid plies 52 and 54 of the strip 56 to each other to define the spring pockets, as well as the line 58 of attachment which closes the pockets along the side edges of the piles between which the spring was inserted, are formed of discrete individual welds 60 rather than as a continuous weld. It will also be observed that, as illustrated, the individual welds 60 are spaced apart within the line by a distance approximately equal to the length of the individual welds along the line, and, further, that the welds at each end of the transverse lines 50 of welds between the pockets do not intercept either the folded edge 62 of the fabric strip 56 or its overlaid edges 64 between which the spring was inserted.

With an interrupted line of thermal welds and using nonwoven polypropylene fabric earlier referred to, a line of interrupted welds each a quarter-inch long and approximately one-qarter inch in the line, exhibits over forty percent (40%) greater resistance to separation of the pocket-forming plies than the identical material sewed on production equipment for the manufacture of pocketed springs by the conventional stitching method, using thread which is conventional for the single-thread interpocket stitching, viz., Number 30-3 soft cotton.

While thermal welding in the prescribed pattern may be achieved in a variety of ways, including contact heating and high frequency welding, the ultrasonic welding technique appears to be especially suitable in that the internal induction of heat by its mechanical working of the meterial is faster than contact heating, and more controllable as well as less dangerous than high-frequency electrostatic methods. Moreover, within limits, any desired pattern of welding can be achieved ultrasonically in this context by suitable modification of the anvil against which the material to be welded is pressed by the welding horn.

The outer peripheral frame structure 20 may also be constructed of rigid plastic material components and of foamed plastic cushioning material in lieu of the springs or in combination therewith.

In certain instances, so as to impart to the mattress arrangement a still further and more luxurient look, a unitary piece of foamed material or sponge-like rubber material may be inserted in the cavity preferably beneath the mattress core. This will cause the center position of the mattress to arc upwardly into a dome shape, generally referred to as a "loft" appearance, thereby creating an aestheticly appealing mattress.

Figure 7:
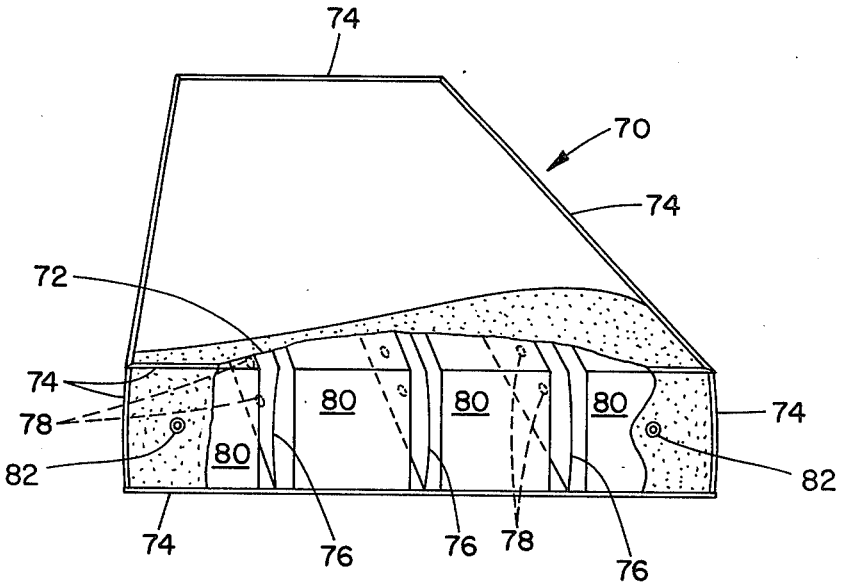
FIG. 7 illustrates a perspective, partially sectional view of a pneumatic mattress core insert.

FIG. 7 is an exemplary embodiment of a core insert 70 which may be utilized in context with the present invention. The mattress structure includes an inflatable outer shell 72 providing for inflation thereof, which may be constructed of sheet vinyl having a suitable thickness such as 20 mils. Preferably, the outer shell is constructed of separate top, bottom and side vinyl pieces which are then seamed, as by a heat sealing, at the edges at 74 to provide a square shape for the core insert. The inner structure of the mattress is divided by a plurality of vertically and longitudinally extending compartment walls 76, formed for example by vinyl strips, into a plurality of multiple inflatable compartments. The compartment walls 76 are attached to the inner, upper and lower surfaces of the shell 72, as by heat seals, and thereby function to control the shape of the outer shell when inflated, maintaining the top of the mattress as an essentially flat surface. The walls 76 normally are provided with a plurality of communicating vent apertures 78 along their lengths such that each compartment is maintained at the same pressure as every other compartment. The inflatable compartments extend, side by side, longitudinally along the length of the mattress, and each has a substantially rectangular cross section.

A foam padding or fiberfill support block 80 may be positioned in each of the inflatable compartments, with the support blocks extending vertically for substantially the full height of the compartments to provide body for the mattress and substantial support for loads imposed on the mattress. The support blocks have a rectangular cross section substantially filling the cross section of the compartments, and also extend longitudinally in the compartments for substantially the entire length of the mattress. In this arrangement, the foam or fiberfill support blocks and the contained air cooperate to produce a stable and comfortable mattress. Moreover, the foam blocks provide ridigity and shape to the mattress in the event of a deflation thereof. The support blocks may be formed of any suitable fiberfill or foamed rubber of polymer material such as foamed polyurethane. The mattress outer sheet 72 is provided with one or more conventional air valves 82 to provide for inflation of the mattress and also adjustment of the air pressure therein to control the firmness of the mattress.

While several embodiments and variations for an air bed arrangement have been described in detail herein, it should be apparent that the teachings and disclosure of the present invention will suggest many other embodiments and variations to those skilled in this art.

What is claimed is:

1. A mattress foundation designed to be used in combination with an accompanying inflatable mattress, comprising a primary support structure for supporting a mattress and any loads imposed thereon; a compartment defined with said support structure; and an air compressor positioned within said compartment, said primary support structure including a first area of support structure extending for substantially the full height of the mattress foundation and a second area of support structure extending from the top surface of the foundation to only a portion of the full height of the mattress foundation, said compartment being positioned below said second area of said support structure, said first area including a first inflatable support structure extending for substantially the full height of the mattress foundation, and said second area including a second inflatable support structure extending from the top surface of the foundation to only a portion of the full height of the mattress foundation.

2. A mattress foundation designed to be used in combination with an accompanying inflatable mattress as claimed in claim 1, further comprising a control panel, positioned on a side surface of the foundation, for controlling said compressor.

3. A mattress foundation designed to be used in combination with an accompanying inflatable mattress as claimed in claim 1, said compressor being pneumatically coupled to said first and second inflatable support structures.

4. A mattress foundation designed to be used in combination with an accompanying inflatable mattress as claimed in claim 3, including a control panel positioned on a side surface of the foundation for providing control over said compressor.

5. A mattress foundation designed to be used in combination with an accompanying inflatable mattress as claimed in claim 1, said first area of support structure including a first array of coil springs extending for substantially the full height of the mattress foundation, and a second array of coil springs extending from the top surface of the foundation to only a portion of the full height of the mattress foundation.

6. A bed arrangement having a mattress foundation in combination with an inflatable mattress, comprising:

a. a mattress foundation having a primary support structure for supporting a mattress and any loads imposed thereon, a compartment defined within said support structure, and an air compressor positioned within said compartment; said primary support structure including a first area of support structure extending for substantially the full height of the mattress foundation and a second area of support structure extending from the top surface of the foundation to only a portion of the full height of the mattress foundation, said compartment being positioned below said second area of support structure, said first area including a first inflatable support structure extending for substantially the full length of the mattress foundation, and said second area including a second inflatable support structure extending from the top surface of the foundation to only a portion of the full height of the mattress foundation;

b. a mattress body including: an outer peripheral section, at least one central core unit, and a removable pillow top removably fastened to said outer peripheral section to allow access to said at least one central core unit, said at least one central core unit having top, bottom and side surfaces which are joined together to form an inflatable outer shell; and c. said central core unit being pneumatically coupled

7. The bed arrangement set forth in claim 6 wherein in said inflatable outer shell is divided into a plurality of separate compartments formed by spacer surfaces extending between said top and bottom surfaces to maintain a substantially rectangular shape for the outer shell, said separate compartments pneumatically communicating with each other through apertures in the spacer surfaces such that the resilient firmness of the outer shell is adjustable by one common pressure therein.

8. An arrangement as claimed in claim 6, said mattress peripheral section comprising pocketed coil springs.

9. An arrangement as claimed in claim 8, said pocketed coil springs comprising non-nested coil springs.

10. An arrangement as claimed in claim 8, said pocketed coil springs being interconnected through ultrasonic welding of the material housing said coil springs.

11. An arrangement as claimed in claim 8, said coil springs being formed of a metallic material.

12. An arrangement as claimed in claim 8, said coil springs being formed of a plastic material.

13. An arrangement as claimed in claim 6, further comprising a control panel, positioned on a side surface of the foundation, for controlling said compressor.

14. An arrangement as claimed in claim 6 said compressor being pneumatically coupled to said first and second inflatable support structure.

15. An arrangement as claimed in claim 14 including a control panel positioned on a side surface of the foundation for controlling said compressor.

* * * * *